US010543694B2

(12) United States Patent
Pourtier et al.

(10) Patent No.: US 10,543,694 B2
(45) Date of Patent: Jan. 28, 2020

(54) METHOD AND DEVICE FOR CLEANING AND PROTECTING A HYDRAULIC CONNECTION

(71) Applicant: Dover Europe Sàrl, Vernier (CH)

(72) Inventors: Francis Pourtier, Charmes sur Rhone (FR); Jean-Pierre Arpin, Beaumont-Monteux (FR)

(73) Assignee: DOVER EUROPE SÀRL, Vernier (CH)

( * ) Notice: Subject to any disclaimer, the term of this patent is extended or adjusted under 35 U.S.C. 154(b) by 156 days.

(21) Appl. No.: 15/550,909

(22) PCT Filed: Feb. 12, 2016

(86) PCT No.: PCT/EP2016/053070
§ 371 (c)(1),
(2) Date: Aug. 14, 2017

(87) PCT Pub. No.: WO2016/128566
PCT Pub. Date: Aug. 18, 2016

(65) Prior Publication Data

US 2018/0029375 A1 Feb. 1, 2018

(30) Foreign Application Priority Data

Feb. 13, 2015 (FR) ..... 15 51203

(51) Int. Cl.
*B41J 2/175* (2006.01)

(52) U.S. Cl.
CPC ..... *B41J 2/17596* (2013.01); *B41J 2/17523* (2013.01); *B41J 2/17526* (2013.01)

(58) Field of Classification Search
CPC ..... B41J 2/165; B41J 2/16517; B41J 2/1652; B41J 2/16522; B41J 2/16594;
(Continued)

(56) References Cited

U.S. PATENT DOCUMENTS 4,628,329 A 12/1986 Regnault
4,910,529 A 3/1990 Regnault
(Continued)

FOREIGN PATENT DOCUMENTS

FR 2 618 728 A1 2/1989
FR 2 954 215 A1 6/2011
(Continued)

OTHER PUBLICATIONS

Translation of FR2618728, published on Feb. 1989 (Year: 1989).*
(Continued)

*Primary Examiner* — Huan H Tran
(74) *Attorney, Agent, or Firm* — Pearne & Gordon LLP

(57) ABSTRACT

The invention concerns a method for cleaning an ink circuit of an ink-jet printer, comprising at least one tank (10), referred to as the main tank, at least one ink cartridge (30), a pump (31) for pumping the ink from the cartridge, ducts and valves (32-35, 320, 340, 341, 343, 344) for fluid connection between the ink cartridge and the tank, and control panel (3) for controlling the printer, the method comprising at least: a step of sending solvent, at a pressure P1, to the cartridge (30), by at least a part of the ducts and valves for fluid connection between the ink cartridge (30) and the tank (10), a step of pumping at least a portion of the solvent, sent in step a), towards the main tank (10).

23 Claims, 6 Drawing Sheets

(58) Field of Classification Search
CPC ..... B41J 2/17596; B41J 2/17526; B41J 2/17523; B41J 2/20; B41J 2/175; B41J 2/18; B41J 2/17566; B41J 2/185
See application file for complete search history.

(56) References Cited

U.S. PATENT DOCUMENTS

| | | | | |
|---|---|---|---|---|
| 6,145,954 | A | 11/2000 | Moore | |
| 8,613,501 | B2 * | 12/2013 | Tomlin | B41J 2/175 347/84 |
| 8,882,231 | B2 * | 11/2014 | Morgan | B41J 2/18 347/18 |
| 9,764,558 | B2 * | 9/2017 | Pourtier | B41J 2/175 |
| 2012/0299989 | A1 | 11/2012 | Prothon | |
| 2012/0327145 | A1 | 12/2012 | Pouzet | |
| 2016/0052291 | A1 | 2/2016 | Pourtier | |
| 2016/0332449 | A1 | 11/2016 | Pourtier | |
| 2016/0347074 | A1 | 12/2016 | Ribeiro | |
| 2017/0028736 | A1 | 2/2017 | Pourtier | |
| 2017/0182787 | A1 * | 6/2017 | Pourtier | B41J 2/175 |
| 2017/0217200 | A1 | 8/2017 | Ribiero | |

FOREIGN PATENT DOCUMENTS

| | | | | |
|---|---|---|---|---|
| JP | 2001-071532 | A | 3/2001 | |
| WO | 88/04235 | A1 | 6/1988 | |
| WO | 2005/068203 | A1 | 7/2005 | |
| WO | WO-2009049135 | * | 4/2009 | B41J 2/175 |
| WO | 2011/076810 | A1 | 6/2011 | |
| WO | WO-2014154833 | A1 * | 10/2014 | B41J 2/175 |

OTHER PUBLICATIONS

Translation of JP 2001-071532, published on Mar. 2001 (Year: 2001).*
Search Report issued in French Patent Application No. 1551203 dated Dec. 1, 2015.
International Search Report issued in Patent Application No. PCT/EP2016/053070 dated Aug. 9, 2016.

* cited by examiner

METHOD AND DEVICE FOR CLEANING AND PROTECTING A HYDRAULIC CONNECTION

TECHNICAL FIELD AND PRIOR ART

The invention relates to the field of printers, especially of the continuous ink-jet (CU) type.

It also relates to the architecture (the arrangement of the ink circuit) of a printer, for example of the CIJ type, in particular in order to prevent situations in which some channels followed by the ink can be clogged in use.

The continuous ink-jet (CU) printers are well-known in the field of industrial coding and labelling of various products, for example for labelling bar codes, the best-before date on food products, or even references or distance marks on cables or pipes directly on the production line and with a large rate. This type of printer can also be found in some fields of decoration where the possibilities of graphic printing of the technology are used.

These printers have several typical sub-sets as shown in FIG. 1.

First, a printing head 1, being generally offset with respect to the body of the printer 3, is joined thereto by a flexible umbilical 19 grouping the hydraulic and electrical connections necessary for the operation of the head giving it a flexibility which facilitates integration on the production line.

The body of the printer 3 (also referred to as a control panel or case) usually contains three sub-sets:

- an ink circuit in the lower part of the control panel (area 4'), which enables on one hand, the ink to be supplied to the head at a stable pressure and with an adequate quality, and on the other hand, the ink of the jets which is not used for printing to be handled,
- a controller located at the top of the control panel (area 5'), able to manage the sequencing of actions and to carry out the processing for activating the different functions of the ink circuit and of the head.
- an interface 6 which gives the operator the means for implementing the printer and for being informed regarding the operation thereof.

In other words, the case includes 2 sub-sets: in the top part, the electronics, the power supply and the operator interface, and in the bottom part an ink circuit supplying the ink, with a nominal quality, under pressure to the head and the depression for retrieving the ink not used by the head.

FIG. 2 schematically shows a printing head 1 of a CIJ printer. It includes a drop generator 60 supplied with electrically conducting ink pressurised by the ink circuit 4.

This generator is able to produce at least one continuous jet through a small-dimensioned aperture called a nozzle. The jet is transformed into an even succession of identical size drops under the effect of a periodical stimulation system (not shown) located upstream of the nozzle outlet. When the drops 7 are not intended for printing, they head for a gutter 62 which retrieves them in order to recycle the unused ink and send them back into the ink circuit 4. Devices 61 placed along the jet (charge and deflection electrodes) enable to control the drops to be electrically charged and deflected in an electrical field Ed. The drops are then deviated from their natural ejection path of the drop generator. The drops 9 intended for printing escape from the groove and are deposited on the medium to be printed 8.

This description can apply to continuous jet printers (CU) referred to as binary or multi-deflected continuous jet printers. The binary CIJ printers are fitted with a head the drop generator of which has a multitude of jets, each drop of a jet being only able to be directed towards 2 paths: printing or retrieving. In the multi-deflected continuous jet printers, each drop of a single jet (or of a few spaced apart jets) can be deflected on various paths corresponding to different charge orders from one drop to the other, thus performing a scanning of the area to be printed along a direction which is the deflection direction, the other direction for scanning the area to be printed is covered by a relative displacement of the printing head and of the medium to be printed 8. Generally, the elements are arranged so that these 2 directions are substantially perpendicular.

An ink circuit of a continuous ink-jet printer first enables ink under regulated pressure, and possibly a solvent, to be supplied to the drop generator of the head 1 and a depression to be created to retrieve the fluids not used for printing back from the head.

It also enables consumables (distribution of ink and solvent from a storage) to be managed and the quality of the ink (viscosity/concentration) to be controlled and maintained.

Finally, other functions are related to the comfort of the user and the automatic support of some maintenance operations in order to ensure an identical operation whatever the conditions of use. Among these functions, there are the rinsing with a solvent of the head (drop generator, nozzle, groove), the preventive maintenance assistance such as the replacement of components with a limited lifetime (filters, pumps).

These different functions have very different purposes and technical requirements. They are activated and sequenced by the controller 5' of the printer which will be all the more complex as the number and sophistication of the functions are large. Regarding the inks used, those containing pigments, for example titanium oxide (rutile or anatase $TiO_2$), as sub-micronic sized particles, are particularly interesting for their whiteness and opacity. They are called pigmented inks and are used for marking and identifying black or dark media.

However, the dense particles of pigments naturally tend to settle, especially in the ink supply ducts, when the ink is at rest. The consequences of this settling can be the formation, in these ducts, of solid clogs which can clog them, partially or even totally. Furthermore, during the essential maintenance operations, venting the connectics, in the presence of ink, can form clogs of dry ink. The same problem also concerns the hollow needle for connecting ink cartridges to the ink circuit: ink is supplied to the circuit from a cartridge, a consumable element that the user replaces when it is empty. Connection to the ink circuit is carried out by a hollow needle which fits into an adapted opening of the cartridge and which also constitutes an area of ink settling and of solid clog formation.

This can in particular result in ink supply difficulties as well as in an opacity loss of markings.

These problems are critical and, since the ink cannot be stirred when it is in the ducts and connection means, dictate the intervention of a technician: the printer is then blocked, the production is stopped, which generates a dissatisfaction of the user as well as a loss of time and costs.

In the specific field of ink-jet printers, no technique is known enabling these problems of connection clogging to be solved, in particular the ducts or pipes or the nozzle, in which ink is brought to flow, especially from the ink cartridge towards the main ink tank.

There is therefore the problem of making an ink circuit, and a method for operating an ink circuit, which enables the hydraulic connectics to be cleaned, at least between an ink cartridge and an ink circuit, in particular in the case of a pigmented ink.

Furthermore, generally speaking, the consumables used in this type of device, and especially the ink and solvent, are expensive elements.

It is therefore attempted to minimise their consumption while suppressing the clogging of ducts and connections of the ink circuit.

The same problem raises in the case of any ink, even a non-pigmented ink, which can dry and form deposits of dry matter in the ducts and connections of the ink circuit.

DISCLOSURE OF THE INVENTION

The invention first relates to a method for cleaning an ink circuit of an ink-jet printer, comprising at least one tank, referred to as the main tank, at least one ink cartridge, a pump for pumping the ink from the cartridge and means for fluid connection between the ink cartridge and the tank, and means for controlling the printer, this method comprising at least:

a) a step of sending solvent, at a pressure P1, to the cartridge, by at least a part of the means for fluid connection between the ink cartridge and the tank, b) a step of pumping at least a portion of the solvent, sent in step a), towards the main tank.

The means for fluid connection between the ink cartridge and the tank enable a fluid (or a liquid, generally ink, but here also solvent) to be brought from the ink cartridge to the main tank.

Prior to step a), a method according to the invention can comprise a step of detecting the clogged state of at least a part of the means for fluid connection between the ink cartridge and the tank, for example by measuring the variation of the ink level in the main tank, when pumping ink from the ink cartridge towards the main tank.

During step a), the solvent can be sent to the cartridge by a part of the means for fluid connection between the ink cartridge and the tank, the solvent flowing in the reverse direction to the flowing direction of the ink, when the latter is sent from the ink cartridge towards the tank.

Step b) can be carried out using said pump for pumping ink, from said ink cartridge towards the main tank.

Steps a) and b) can be reiterated.

Pressure P1 can be between 1 and 10 bars.

A method according to the invention can also comprise a step of sending solvent in the cartridge and in at least a part of the means for fluid connection, without a step of pumping at least a portion of the solvent thus sent towards the main tank.

According to an embodiment, a method according to the invention can comprise a step, prior to step a), of detecting the presence of the ink cartridge, for example by exchanging at least one datum, between an electronic or electric circuit associated with the cartridge and the means for controlling the printer.

The solvent sent during step a) can be taken in a part of the main tank. Prior to step a), a step of detecting the solvent level in the main tank can be carried out. As an alternative, the solvent can be taken in a removable cartridge. The solvent can be sent using means for pumping or pressurising, by a circuit which can be partly different from the one used during step b).

A method according to the invention can comprise a step, prior to step a), of detecting the empty state of the ink cartridge, for example carried out from at least one measurement of the ink level in the main tank.

During step b), at least a portion of the solvent can be transferred towards an intermediate tank, separate from the main tank. The solvent thus stored in the intermediate tank can then be transferred towards the so-called main tank.

After step a), the solvent can be maintained under a pressure P1, a measurement of the variation in the solvent pressure or in the level or volume of the solvent being carried out. If a decrease in the solvent pressure, or in the level or volume of the solvent, for example greater than a threshold value, is measured, a removal of a clog or of a clogged state from a part of the circuit can be concluded.

If a decrease in the solvent pressure, or in the level or volume of the solvent, greater than a threshold value, is not measured, which can express a continuation of a clogging situation, one or more variations in the solvent pressure can be performed. According to an embodiment, the pressure can therefore be temporarily increased in the circuit, for example by several pressure surges (or variations or impulses).

If the duration of the cleaning or unclogging operations is longer than a predetermined duration $\Delta t$, then it can be decided to stop the cleaning and, for example, to change the ink module. Otherwise, as long as the predetermined duration has not been reached, a test regarding the circuit clogging or the unclogging operations can be performed again.

Advantageously, measuring the variation in the solvent pressure or in the level or volume of the solvent enables the releasing efficiency to be checked, and possibly if it is not the case, one or more variations in the solvent pressure to be performed or reiterated.

During step a), the solvent can be sent to the cartridge without passing through the pump for pumping ink from the cartridge, or by passing through said pump.

The invention also relates to an ink circuit of a continuous ink-jet printer, comprising at least one tank, referred to as the main tank, and means for controlling the printer, the latter being programmed to implement a method according to the invention.

The invention also relates to an ink circuit of a continuous ink-jet printer, comprising a tank, referred to as the main tank, a pump for pumping ink towards the tank, means for connecting an ink cartridge to the circuit, means for fluid connection between said means for connecting an ink cartridge to the circuit and the tank, and means for controlling the printer, these means being provided for:

a) sending the solvent, at a pressure P1, up into said means for connecting an ink cartridge to the device, through at least a part of said means for fluid connection, b) pumping at least a portion of a solvent, present in said means for joining an ink cartridge to the device and in at least a part of said means for fluid connection.

The means for fluid connection between the ink cartridge and the tank enable a fluid (generally ink) to be brought from the ink cartridge to the tank.

The means for controlling the printer can further be provided for detecting, prior to sending the solvent, the clogged state of at least a part of the means for fluid connection between the ink cartridge and the tank.

These means for example comprise means for measuring the variation in a fluid level (for example ink) in the main tank, for example, following or during, an ink pumping from an ink cartridge towards the main tank.

Means can be provided for maintaining a fluid (or a liquid, for example solvent) under pressure in the circuit, as well as means for measuring a variation in the fluid pressure (for example solvent) or in a level or volume of this fluid.

Such means can enable one or more variations in the liquid pressure (or solvent) to be performed, especially in the case where the means for measuring a pressure variation do not detect a decrease in the fluid pressure, or in the level or volume of the fluid, greater than a threshold value.

Advantageously, a circuit according to the invention comprises means for performing or reiterating one or more variations in the fluid pressure in the circuit, for example if a variation in the fluid pressure (or a liquid, for example solvent) or in a level or volume of this fluid is not detected.

Said means for fluid connection can be connected to means for injecting a solvent therein.

An ink circuit according to the invention can comprise means for measuring an ink level in the main tank, said means for controlling the printer enabling to compute, for example from a measurement of an ink level in the main tank, a residual ink level in an ink cartridge connected to the means for fluid connection.

An ink circuit according to the invention can further comprise an intermediate tank, separate from the main tank and means for transferring, towards said intermediate tank, at least a portion of a fluid (or a liquid, especially solvent), present in said means for connecting an ink cartridge to the circuit and in at least a part of said means for fluid connection.

An ink circuit according to the invention can further comprise:

- means for sending a fluid (or a liquid, for example solvent), towards or up into, said means for connecting an ink cartridge to the circuit, through at least a part of said means for fluid connection, but without circulating this fluid through the pump for pumping the ink from the cartridge;
- and/or means for sending a fluid (or a liquid, for example solvent) towards, or up into, said means for connecting an ink cartridge to the circuit, through at least a part of said means for fluid connection, by circulating this fluid through the pump which enables ink to be pumped from the cartridge.

Means can be provided for selecting either one of the flowing paths of such a fluid, and therefore through the pump for pumping ink, or not.

The invention also relates to an ink-jet printer, comprising:

- an ink circuit according to the invention,
- a printing head,
- hydraulic connection means, for bringing, from the ink tank, an ink to be printed to the printing head and sending, towards said ink circuit, an ink to be retrieved from the printing head,
- electrical connection means for supplying power to said printing head.

The ink-jet printer implemented in a method according to the invention, or in a device according to the invention can be a continuous ink-jet (CU) printer, especially of the binary type, or a multi-deflected continuous ink-jet printer.

DETAILED DISCLOSURE OF AN EMBODIMENT

Figure 3A:
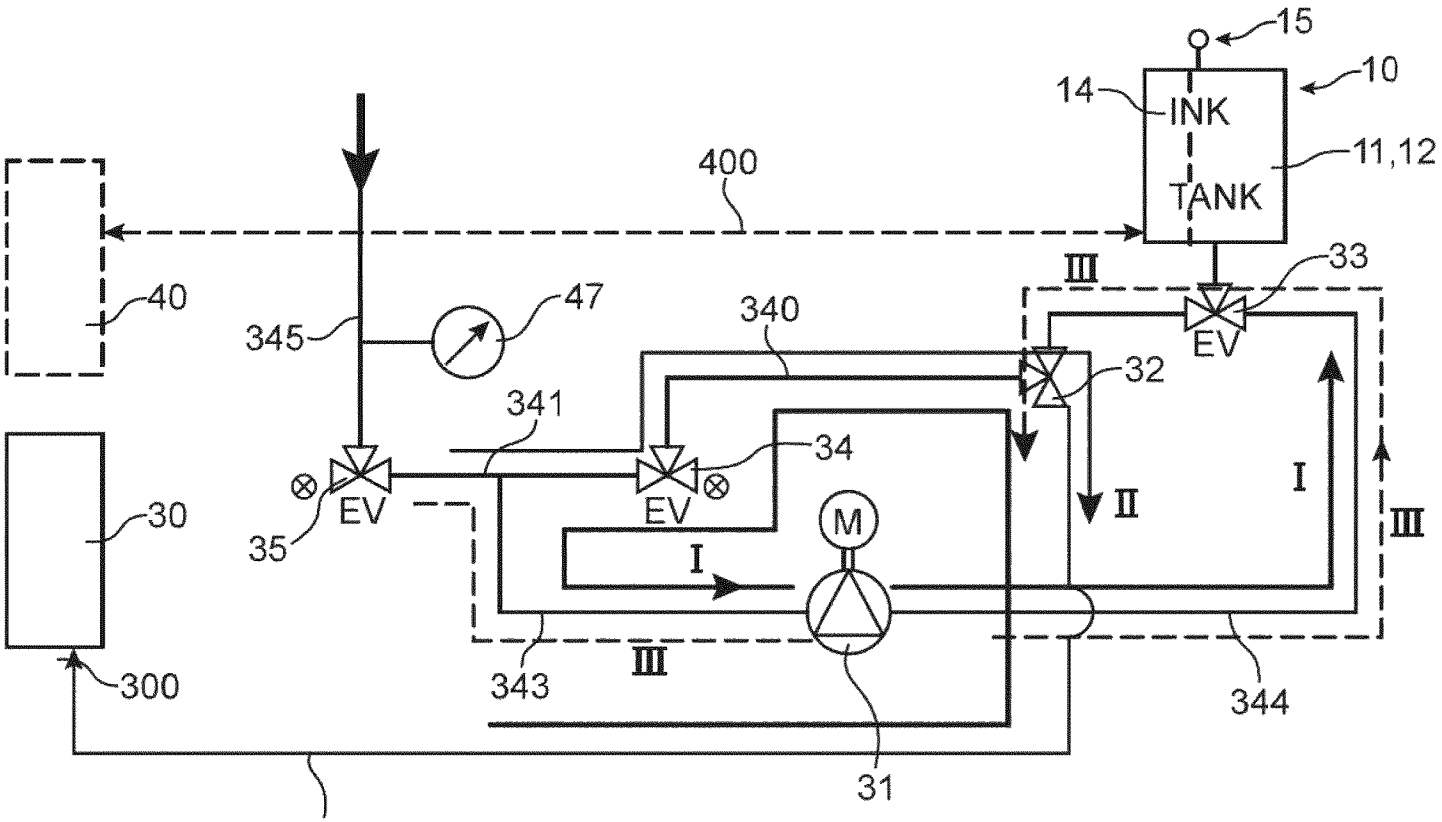
FIG. 3A is an exemplary fluid circuit according to the present invention.

FIG. 3A shows a removable ink cartridge 30 and an exemplary part of an ink circuit of the machine, between the cartridge 30, the main tank 10 and the solvent cartridge 40 which is also removable.

The reference numeral 300 refers to the hollow needle (or any equivalent means), which enables the cartridge 30 to be joined, from a fluidic point of view, to the remainder of the circuit.

When the cartridge 30 is in place, ink can be pumped, using means for pumping 31, in the direction of the main tank 10 via means for fluid connection, comprising ducts 320, 340, 341, 343, 344 and valves (or electric solenoid valves) 32, 33, 34, 35, which can be "three-way"-type valves. Thus, the pump 31 pumps ink, from the cartridge 30, which successively passes, via the valves 32 and 34, through the ducts 320, 340, 341, 343, 344, to be then sent, via the valve 33, towards the main tank 10 (path I in FIG. 3A).

Means 35, 345 enable a solvent under pressure to be introduced, for example at a pressure between 1 and 10 bars, or between 1 bar and 5 bars, into these means for fluid connection. According to the illustrated embodiment, these means comprise, on one hand, the valve 35, and on the other hand, a duct 345 disposed upstream of the valve 35. After opening this valve 35 (at the position NC in FIG. 3A), and as a function of the opening or closing state of the valves 32 and 34 (at a position NC in FIG. 3A), this solvent can be directed, successively by the ducts 341, 340, and 320, up to the cartridge 30 (see the flowing path II in FIG. 3A); as an alternative, the solvent can pass by the path III, successively through the ducts 341, 343, 344, 320, up to the cartridge 30, which also enables the pump 31 to be cleaned. The solvent will therefore flow in parts of the circuit which, as above-explained, have been previously used to inject, along a flowing direction reverse to that of the solvent, ink in the main tank 10. This is the case of ducts 341, 340, 320 and of the hollow needle 300.

A pressure sensor 47 can be disposed, in the scheme of FIG. 3A, upstream of the valve 35, on the path of the solvent.

This solvent under pressure will make it possible to dissolve or destroy the clogs of ink residues which can be formed in the ducts 341, 340, 320, or in the valves 35, 34, 32, or in the hollow needle 300. Advantageously, and as more precisely described below, this is performed after detecting a clogged state of a part of the circuit, on the path of the ink. Cleaning the fluid connections can thus be performed, which is particularly interesting to implement after detecting a clogged state of a part of the circuit and/or after the cartridge 30 has been emptied, but before it is removed to be replaced with a full cartridge.

The tank, referred to as the main tank 10, can be structured into several compartments 11-14, among which a compartment 14 containing solvent.

The solvent can come from a solvent removable cartridge 40 (shown as interrupted lines in FIG. 3A), connected through means 400 for fluid connection (schematised by interrupted lines in FIG. 3A) to the main tank, these means 400 especially comprising a pump (not shown in FIG. 3A). The main tank 10 can be fitted with means 15 for detecting the level of ink it contains. In the main tank, the solvent is mixed with ink (the mixture itself being called "ink").

The solvent under pressure sent during the above-described cleaning can come from the solvent compartment 14 of the tank 10. Means can be provided for detecting a solvent level in this compartment. As an alternative, the solvent can come directly from the cartridge 40. In any cases, it is pressurised by the pump dedicated to pump the solvent.

As explained above in the case of an example, a part of the path (FIG. 3A, path I) taken by the ink, at the outlet of the cartridge 30 and towards the main tank 10, can then be taken, along a reverse flowing direction (FIG. 3A, path II), by the solvent, coming from the solvent cartridge 40 or from the part 14 of the main tank 10 containing solvent.

The solvent under pressure, sent to the cartridge 30, can then be pumped towards the main tank 10. The path of the solvent is then the one usually used by the ink (FIG. 3A, path I), from the cartridge 30 towards the main tank 10: after cleaning, the valve 35 is closed (at the position NO in FIG. 3A) and the pump 31 is activated to send the cleaning solvent towards the tank 10. The solvent thus enables the ducts into which it will flow, as well as the hollow needle 300 to be cleaned; then it can be maintained in the circuit, without being lost.

As already indicated above, this can be done when the cartridge 30 is empty, which can be detected especially, via the variations in the measurement of level in the main tank 10: it is the case, for example, if the variation in the ink level is lower than a threshold value (for example 5/10 mm) for a predetermined duration (for example 20s), even though the pump 31 operates to inject ink in the main tank 10.

An exemplary cleaning sequence, implementing the above-described method, can be as follows:

a) 1$^{st}$ rinsing of ducts 341, 340, 320, of valves 35, 34, 32 and of the hollow needle 300 by solvent under pressure (FIG. 3A, path II), and then retrieving the solvent in the tank 10 (FIG. 3A, path I);

b) 2$^{nd}$ rinsing of the ducts 341, 340, 320 and of the hollow needle 300 by solvent under pressure (FIG. 3A, path II), and then retrieving the solvent in the tank 10 (FIG. 3A, path I);

c) final rinsing of the ducts 341, 340, 320 and of the hollow needle 300 by solvent under pressure (FIG. 3A, path II), without retrieving towards the tank 10; maintaining the solvent during this step enables any subsequent clogging to be avoided by maintaining solvent in the cartridge, which avoids any drying.

The means for controlling the printer (also called "controller") are implemented as an electrical or electronic circuit, or as a processor or microprocessor, programmed to implement a cleaning method according to the invention, for example such as described above. It is this controller which drives the opening and closing of the valves, as well as the activation of the pumping means, in order to circulate the solvent according to what have just been described. The controller is also programmed to manage operations other than cleaning, especially the printing operations.

Detecting, prior to the above-described cleaning operations, the "empty" state of the cartridge 30, is performed from measurements of ink level, for example measurements of level carried out in the main tank 10 using the means 15, and using the controller. The latter also makes the decision, and sends the instructions, to circulate the solvent under pressure towards the cartridge 30, and then to pump the same towards the main tank 10.

For safety purposes, prior to sending solvent under pressure towards the cartridge 30, one should make sure that the latter is still in place.

This checking, as the cleaning method, can also be carried out using the controller.

Figure 4:
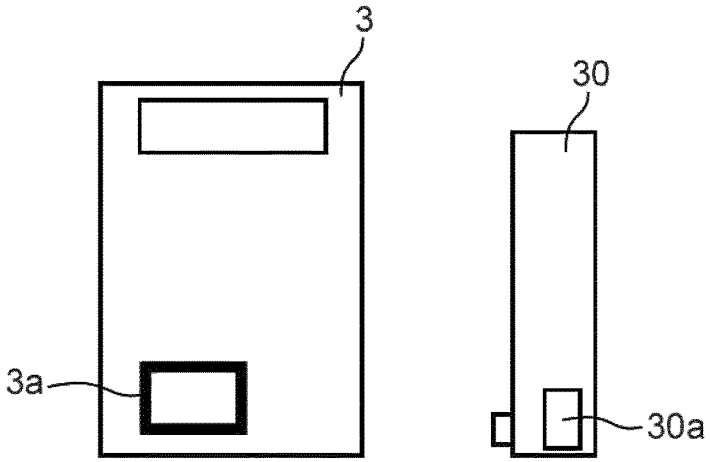
FIG. 4 shows an ink cartridge and the controller-forming means of a printing machine.

To do so, as illustrated in FIG. 4, a cartridge 30 can be used fitted with a circuit 30*a* (subsequently called "tag"), for example embodied as a processor or a microprocessor. This circuit 30*a* is for example applied against a wall of the cartridge 30. It can further comprise communication means, for example an RFID-type interface, which will make it possible to dialogue with the printer controller, especially to supply it with one or more data which can be interpreted as expressing the presence of the cartridge.

As for the controller, it is also fitted with communication means 3*a*, for example an RFID-type interface, which will make it possible to receive the data transmitted by the tag of the cartridge.

As an alternative, communication between the body 3 of the printer and the cartridge 30 can be of the contact type. In this case, contacts are provided, on one hand on the cartridge, on the other hand on the printer, to ensure the transmission of data between the cartridge 30 and the printer. Sending an RFID signal, from the tag to the controller, or reading, by the latter, the presence of the contacts of the tag, enables the presence of the cartridge to be detected. This checking can be periodically carried out, and/or also after detecting an empty state of the cartridge.

After executing the cleaning phases, the replacement of the cartridge 30 with a full cartridge can be accomplished.

From the above description, it is understood that the detection of the "empty" state of the cartridge 30 as well as the cleaning steps which follow the detection are triggered by the machine itself, without the intervention of an operator, and without stopping the machine. The latter can simultaneously continue to print.

Another application of the invention relates to the case where the cartridge 30 is not empty, and where a clogging is detected on the ink path, from the cartridge 30 towards the main tank 10.

Detecting a clogging situation of one of the ink flowing ducts, or of the hollow needle 300, can be carried out, from measurements of solvent pressure or level. This diagnostic can be performed by the controller, which processes the pressure measurements, evaluates the variation in the ink level in the tank for a given pumping duration and power and compares it with what is normally expected in these conditions of pumping duration and power.

According to an embodiment, at the start of the printer, it is checked whether there is a clogging of the connectics. To do so, the following tests can be performed, for example by the controller:

measuring the variation in pressure upon the opening of the circuit (for example the valves 32, 34 and 35 of FIG. 3A, the measurement being carried out by the sensor 47); if there is no variation, then it is concluded that there is a clogging;

and/or measuring the solvent level in the storage 14 upon opening the circuit (for example the valves 32, 34 and 35 of FIG. 3A): if it does not vary, then it is concluded that there is a clogging.

It is then possible, according to what has been described above, especially, along the path II in the case of the circuit of FIG. 3A, to inject solvent under a pressure Ps=P1, for example between 1 and 10 bars, towards the cartridge 30. The pressure Ps can be detected by the sensor 47. This injection can be periodically carried out.

If there is no clogging, or if an obstacle on the path taken by the solvent is removed by the latter, then the solvent pressure Ps decreases, to a value P2<P1. The solvent can then be reinjected in the main tank 10, as explained above.

On the contrary, if the solvent pressure Ps remains stable, a clogging situation is again diagnosed by the controller. Pressure P1 is then maintained, during a certain duration Δt1, for example a few seconds, in order to remove the obstacle. This can possibly be combined with one or more pressure "surges" (or variations or impulses), for example by opening and closing cycles of the electric solenoid valve 35, to reach a pressure P3>P1, each of these "surges" being for example generated during a short period, of a duration Δt2<Δt1. Following this, if pressure Ps decreases, to the value P2<P1, it means that the obstacle has been removed, and the solvent can be reinjected in the main tank 10, as explained above. If pressure Ps does not decrease yet, for example after a certain duration which can be in the order of a few tens of seconds, a solution consists in intervening manually and/or changing the hollow needle 300 or the ink module itself (which includes a part of the fluid connections between the cartridge 30 and the main tank).

In the above-mentioned cases, the solvent under pressure, sent towards the cartridge 30, can then be pumped towards the main tank 10. The circuit is thus the one usually used by the ink, from the cartridge towards the main tank: after cleaning, the set of valves 32-35 is reconfigured to send the cleaning solvent towards the main tank 10. The solvent therefore enables the ducts in which it will flow, as well as the hollow needle 300 to be cleaned, and then can be maintained in the circuit, without being lost.

As indicated above, detecting a clogging situation of one of the ducts or of the nozzle can be performed using the controller of the machine. This same controller will:

- make the decision, and send the instruction, to circulate the solvent under pressure towards the cartridge 30;
- process the information coming from the sensor 47, so that it pumps the solvent, towards the main tank 10, or it maintains the pressure thereof in the ducts considered as being clogged.

As in the case of a cartridge explained above, for safety purposes, prior to any sending of the solvent under pressure towards the cartridge 30, one should make sure that the latter is still in place. The means used to do so can be those already explained above (tag 30*a* and controller).

Prior to this method, it can be checked whether the solvent level is sufficient, or greater than the lower limit value. This step can also be carried out in the case of cleaning after detecting the empty state of the cartridge, as explained above.

Figure 5:
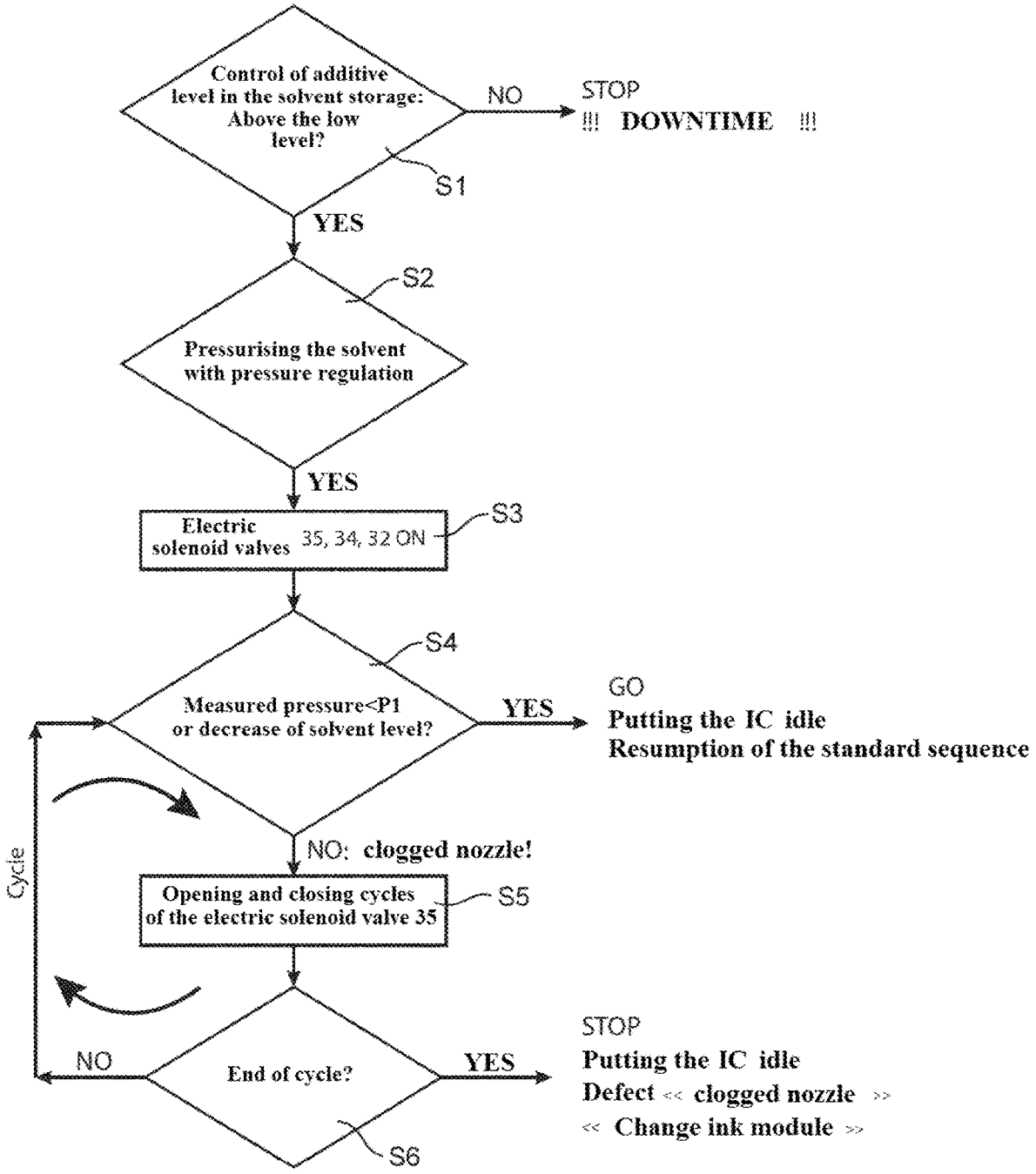
FIG. 5 shows the steps of performing a cleaning method according to the present invention.

An exemplary embodiment of this method is illustrated in FIG. 5.

In a first step (S1), a solvent level in the solvent storage 14 is controlled.

If this level is lower than a predetermined threshold value, then the printing machine is immediately stopped, so that it does not operate with no solvent. This step can also be carried out in the case of cleaning after detecting the empty state of the cartridge.

If it is greater than this threshold value, then the solvent can be pressurised (step S2), for example at a pressure P1 between 1 bar and 10 bars, or between 1 bar and 5 bars. If it is not possible to reach this pressure, then a defect is detected. If this pressure can be reached, then (step S3) sending the solvent towards the ink cartridge 30 is carried out, according to what has been described above, by opening the valves 35, 34, 32.

Subsequently (step S4) a test can be carried out regarding maintaining, or decreasing, the solvent pressure during a certain duration Δt1. For example, it is tested whether, at the end of this duration, the pressure has decreased by a predetermined value, for example between 1%×P1 and 50%×P1 or (by measuring the solvent in the tank 14) if the solvent level or volume has decreased by a predetermined value Δh1 or ΔV1: if the answer is yes to any of these questions, then it is considered that the circuit is unclogged, and the standard operating sequence of the machine can be resumed.

Otherwise, it is considered that the ink circuit is clogged; it can then be attempted (step S5) to temporarily increase the pressure, for example by pressure surges (or variations or impulses) (as already explained above), which can be generated by one or more opening and closing cycles of the valve 35.

A test can also be carried out on the duration of the cleaning or unclogging operations (step S6): if the cycle has a longer duration than the predetermined duration Δt, then it can be decided to stop the cleaning and, for example, to change the ink module. Otherwise, as long as the predetermined duration has not been reached, the test of the previous step S4 can again be carried out.

All the above-described operations can be implemented by the controller of the machine, programmed to do so.

In other words, the diagnostic concerning a clogging situation as well as the remedy which can be provided can be formulated and triggered by the machine itself, without the intervention of an operator, and without stopping the machine. The machine can simultaneously continue to print.

Figure 3B:
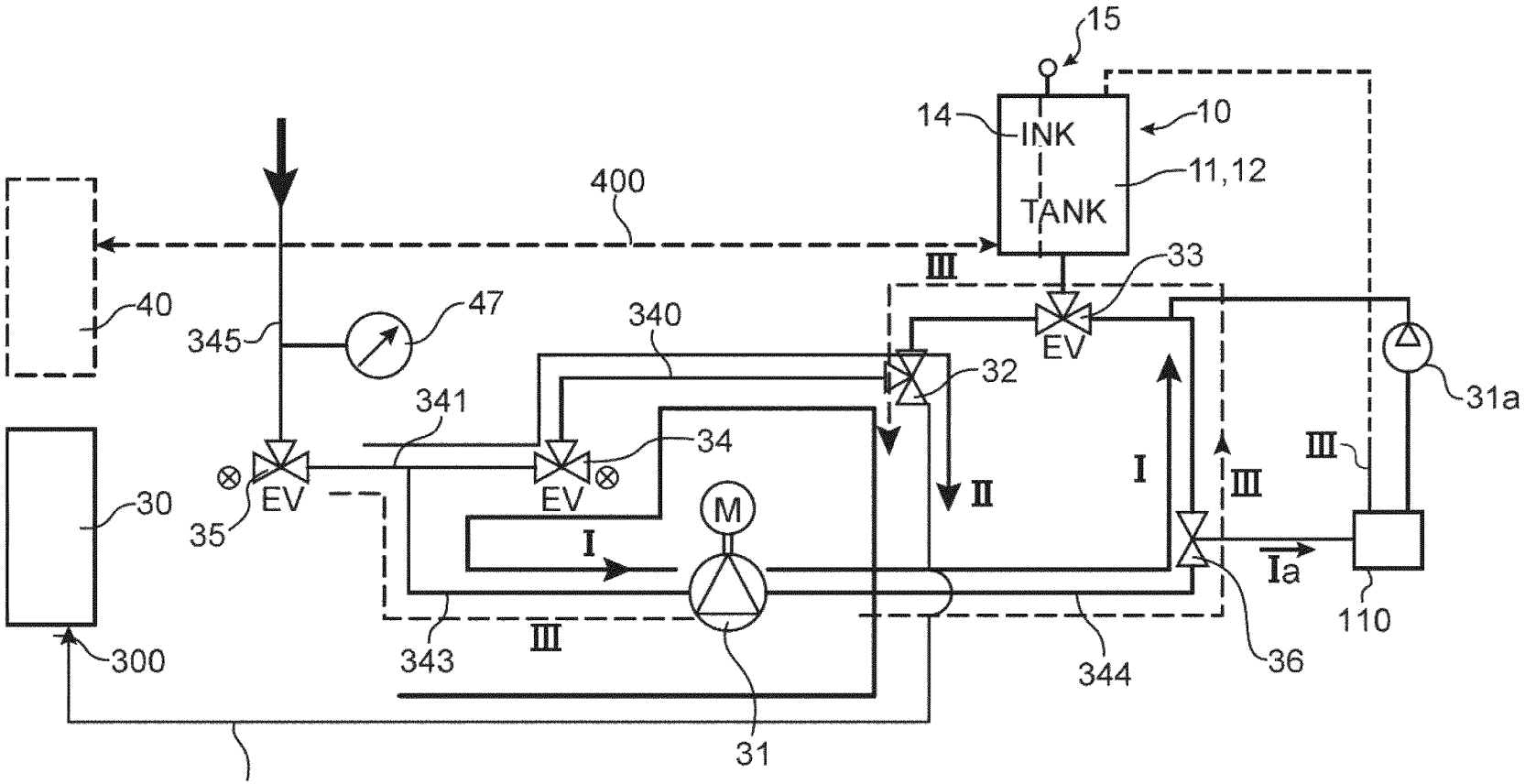
FIG. 3B is an alternative of an exemplary fluid circuit according to the present invention.

An alternative of an above-described circuit is shown in FIG. 3B; it is identical to that of FIG. 3A, except for the presence of an intermediate tank 110, in which the solvent which enabled the cleaning, as explained above, can be temporarily retrieved before being sent towards the main tank 10.

A three-way valve 36 enables the solvent to be directed either directly towards the main tank 10 (along the path I), or towards the intermediate tank 110 (along the path Ia). A pump 31*a* subsequently enables the content of this tank to be pumped towards the main tank 10. The tank 110 is thus placed in parallel to the circuit that the ink follows when it is pumped from the cartridge 30 towards the tank 10.

During a cleaning through the flowing path I, the valve 36 is actuated so as to guide the solvent towards the valve 33, along this path I which therefore remains unmodified with respect to the case of FIG. 3A.

In this alternative, the solvent used to clean the connectics of the ink cartridge can also be used to make additions of solvent in the main ink tank 10 and thus maintain the ink quality, without a sudden addition of solvent in this main tank 10 after such a cleaning.

The additional tank is preferably at atmospheric pressure in order to avoid any overpressure, this can be carried out by joining, through a duct 111, the top of this tank to the top of the main tank 10.

The valve 36 and the pump 31*a* can be actuated by the machine controller, programmed to do so.

Figure 6A:
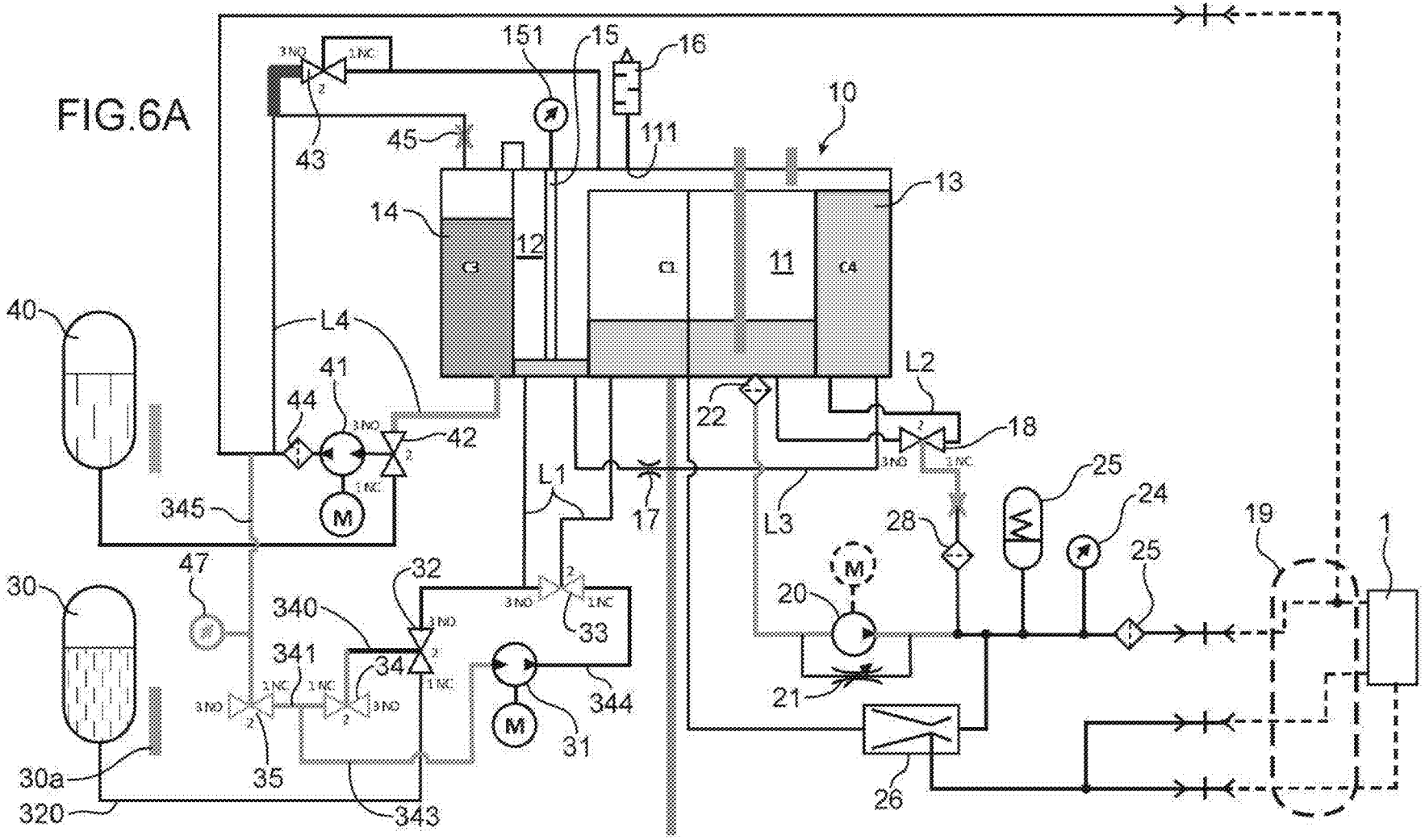
FIG. 6A shows again another exemplary fluid circuit structure using a circuit according to the present invention.

An ink circuit in which the circuit, described above in relation to FIG. 3A, can be used, is illustrated in FIG. 6A. The structure of this circuit is close to the one described in WO 2011/076810.

In this figure, identical reference numerals to those of the previous figures designate identical or corresponding elements.

The main tank is here divided into compartments 11, 12, 13, 14.

The compartment 11 forms an intermediate tank: it constitutes a buffer storage tank in which the ink is stored in a part of the fluid circuit which is intermediate between the ink 30 and solvent 40 cartridges (removable consumable cartridges) and the printing head 1 itself. Fluids coming back from the head are retrieved by this same intermediate tank 11.

Reference 19, which designates the umbilical, which unifies the communication channels for bringing the various fluids towards the printing head, as well as the electrical connections for bringing the electrical signals for the operation of the head.

The ink contained in the tank 11 is serviced with the required quality for an optimum operation of printing, in particular its viscosity is adjusted, as described later thanks to the system according to the invention.

After being coarsely filtered by the filtering grid 22, the ink taken from the intermediate tank 11 arrives at the inlet of the pump 20, for example a gear pump, which pressurises it. This pump 20 is driven by an engine the speed (power) of which is controlled by the controller. The pump 20 can be short-circuited by an adjustable by-pass 21 to adjust its operating range (pressure/rate or pressure/rotating speed characteristics). Downstream of the pump 20, a surge-protection device 23 is disposed, for the reasons explained in WO 2011/076810.

A pressure sensor 24, and possibly a temperature sensor, can be provided, downstream of the surge-protection device 23: the data it provides are used by the controller to slave the ink pressure to a set point, generally when the speed of the ink-jet in the head is not available (for example when the jet ejection is stopped, or the jet speed cannot be measured).

The ink is filtered by the main filter 25 downstream of the sensor 24 before being sent to the head 1.

Regarding the return of fluids not used for printing, the latter are sucked at the head (retrieved by the gutter or returning from draining) through the umbilical 19 using a hydro-ejector 26 which, for example, uses a portion of a flow rate of the pump 20 as a driving energy to create a depression by Venturi effect.

Figure 1:
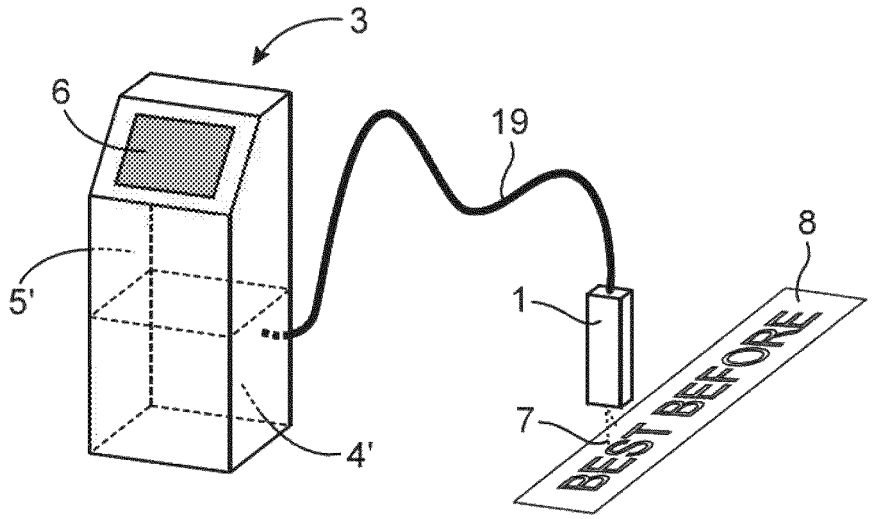
FIG. 1 shows a known structure of a printer.
Figure 2:
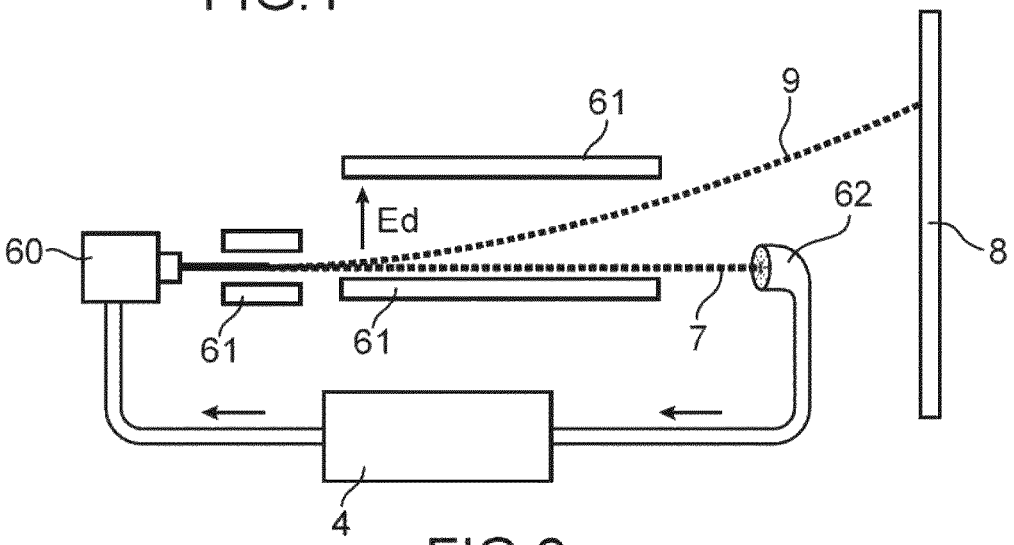
FIG. 2 shows a known structure of a printing head of a CIJ type printer.

The general proceeding of these operations in the circuit can be as follows:

- at the downtime of the jet, solvent is sent to clean the drop generator 2 and the nozzle, and then the draining and gutter circuits 3 are rinsed (including their electric solenoid valves 7 and 8) and, finally, the solvent is sucked from the drop generator 2 and the groove 3 before closing all the electric solenoid valves of the head;
- at the start of the jet, after opening the gutter 62 (FIG. 2) the drop generator 2 is supplied with solvent under pressure and then the supply is gradually passed from the solvent to the ink.

The container 10 is partially partitioned thus defining the four functional tanks 11, 12, 13, 14 connected to each other and to both spared removable consumable cartridges (ink cartridge 30 and solvent cartridge 40) through ducts or passageways and a few active hydraulic components (controlled by the controller) such as four three-way electric solenoid valves (18, 32, 33, 42), a two-way electric solenoid valve 43 and both pumps, for example small capacity diaphragm pumps 31, 41. The ink cartridge 30 and the solvent cartridge 40 make it possible to replace the fluids consumed by the printer in operation. These cartridges do not generally have any own means to measure or detect the fluid volume they contain, the content of the cartridge 30 can be estimated in the manner described below. The cartridges connect on bases connected to the corresponding electric solenoid valves 32, 42.

More precisely, the only container 10, the bottom of which is flat and horizontal, comprises inner walls present only on a portion of its height, dividing it into four tanks 11, 12, 13, 14 opening on the top into a common volume. The four tanks 11, 12, 13, 14 are thus balanced to an identical gas pressure. The inner common volume of the container 10 is in communication with the outside air through a vent 111. Thanks to this vent, air loaded with solvent vapour coming from the discharge of the hydro-ejector 26 which has sucked fluids (ink and air mixture entering the groove 62 of the printing head 1) is enabled to escape to the outside. Before reaching the free air, this air loaded with solvent vapour passes into a passive condenser 16 made up of a cavity fitted with baffles which multiplies the contact surface between the loaded air and the walls of the condenser. Such a condenser 16 enables a portion of a solvent vapours to be condensed on its walls, which returns by gravity into the intermediate tank 11.

Each tank 11, 12, 13, 14 is more or less filled with fluid (or with liquid). Since the partition walls are not made up to the top of the container 10, a full tank can overflow in the adjacent tank. Thus, the tank 13 can be used as an overflow constant level tank in the intermediate tank.

As previously explained, the intermediate tank 11 is the one which contains the ink intended to supply the printing head 1 under pressure and to retrieve the fluids from the return of the latter through the groove 62.

The second tank 12 is the measuring tank since it is in this tank that the measurements themselves of ink and solvent level are carried out thanks to a preferably continuous level sensor 15, fitting it.

The third tank 13 is supplied, in a closed loop, with ink coming from the intermediate tank 11 to constitute an overflow constant level tank towards the intermediate tank 11. More precisely, the ink is pumped thanks to the pump for supplying 20 the intermediate tank 11 and reaches the tank 13 by discharge through the filtering grid 28 and the electric solenoid valve 18 in the position NC (1-2). Thus, filled at a constant level, the tank 13 supplies ink with a constant static pressure. The constant level tank 13 is in permanent hydraulic communication with the measuring chamber 12 using a duct L3 joining their bottom, fitted with a leak master 17, for example a viscous leak with a length far higher than its diameter.

The fourth tank 14 constitutes a solvent tank used for rinsing the head during the starting and stopping operations of the jet. This tank 14 furthermore enables the operation of the printer to be extended when the solvent cartridge 40 is empty, by supplying the solvent necessary for the viscosity correction and thus gives to the user the possibility of postponing the replacement of the empty cartridge. This tank 14 can overflow in the measuring tank 12. This tank can also supply solvent for the cleaning operations according to the invention.

To transfer ink or solvent to the intermediate tank 11, there are provided two sub-sets each consisting in a pump associated with two electric solenoid valves constituting a sub-set dedicated to the transfer of one of the fluids.

Thus for the transfer of ink, a sub-set comprises the pump 31 associated with the electric solenoid valves 32-35. This makes it possible on one hand to transfer new ink from the cartridge 30 towards the intermediate tank 11 and on the other hand, to drain the measuring tank 12 towards the intermediate tank 11.

For the transfer of solvent, another sub-set comprises the pump 41 associated with the electric solenoid valves 42, 43. This makes it possible on one hand to transfer determined amounts of solvent towards the measuring tank 12, either from the solvent cartridge 40 towards the solvent tank 14 by overflow in the tank 12, or from the solvent tank 14 towards the measuring tank 12 and on the other hand, to pressurise solvent, coming from the solvent tank 14, for rinsing the head during the downtimes and starts of the jet. The pump 41 also makes it possible to pressurise solvent for the cleaning operations according to the invention. In this case, the fluid taken from the compartment 14, is sent to the ink cartridge 30 through the duct 345, the valve 35, and then the ducts 341, 340 and 320.

In this exemplary embodiment, except for the solvent supply (hydraulic line L4) coming from the transfer pump of the solvent 41, the hydraulic lines L1, L2, L3 are connected to the container 10 at its flat horizontal bottom, which is that of the four tanks 11, 12, 13 and 14, which allows fluid communications by interconnected vessels.

The sensor 15 can be a continuous level sensor which can measure, at least in a given range of levels, any level of the fluid present in the measuring tank 12. Thus, it is possible, by performing measurements of level, for example cyclically, to know the evolution of the level over time. Such as represented, the continuous level sensor 15 further comprises a pressure sensor 151 sealingly connected to an end of a tube 150, the other end of the tube being open. The tube 150 is arranged vertically in the measuring tank 12 so that the opening of the tube opens in the vicinity of the bottom. There are other devices enabling a level to be measured, especially continuously, for example by ultrasound, capacitive sensors or others.

The pressure sensor 151 measures the static pressure of the fluid column present in the measuring tank 12. The gas pressure above the surfaces of liquid in the container 10 is for the purpose identical to the pressure of the outside air where the sensor 151 is located, which operates as a relative pressure sensor with an outside pressure reference. From knowing the fluid density, the controller deduces the height of the column and therefore the level of the fluid.

The sensor 151 can be calibrated more or less periodically: the sensor offset, which determines the zero level, is measured after a total draining of the measuring tank 12, that is after draining up to below the opening level of the tube 150. The total draining of the measuring tank 12 can be carried out using the electric solenoid valves 32, 33 and the ink transfer pump 31, as explained in WO 2011/076810.

According to an example, the measuring tank 12 and the intermediate tank 11 are put in hydraulic communication through their bottom by switching the electric solenoid valve 33 into the position NC (1-2). The ink taken at the outlet of the pump 20 for pressurising the ink is directed towards the intermediate tank (electric solenoid valve 18 at the position NO (2-3)). Since the constant level tank 13 is in permanent communication with the measuring tank 12, through the leak master 17 by the line L3, the levels of the volumes considered in the tanks 11, 12, 13 tend, after balance, towards a single value which is measured by the sensor 15. Knowing the surface area of the sections of the three tanks 11, 12, 13, the controller deduces therefrom the precise volume of available ink; this is the ink ready for printing, that is of adequate quality (viscosity).

The level measurement can be used, as already explained above, to estimate whether a cartridge 30 is empty, or not.

Figure 6B:
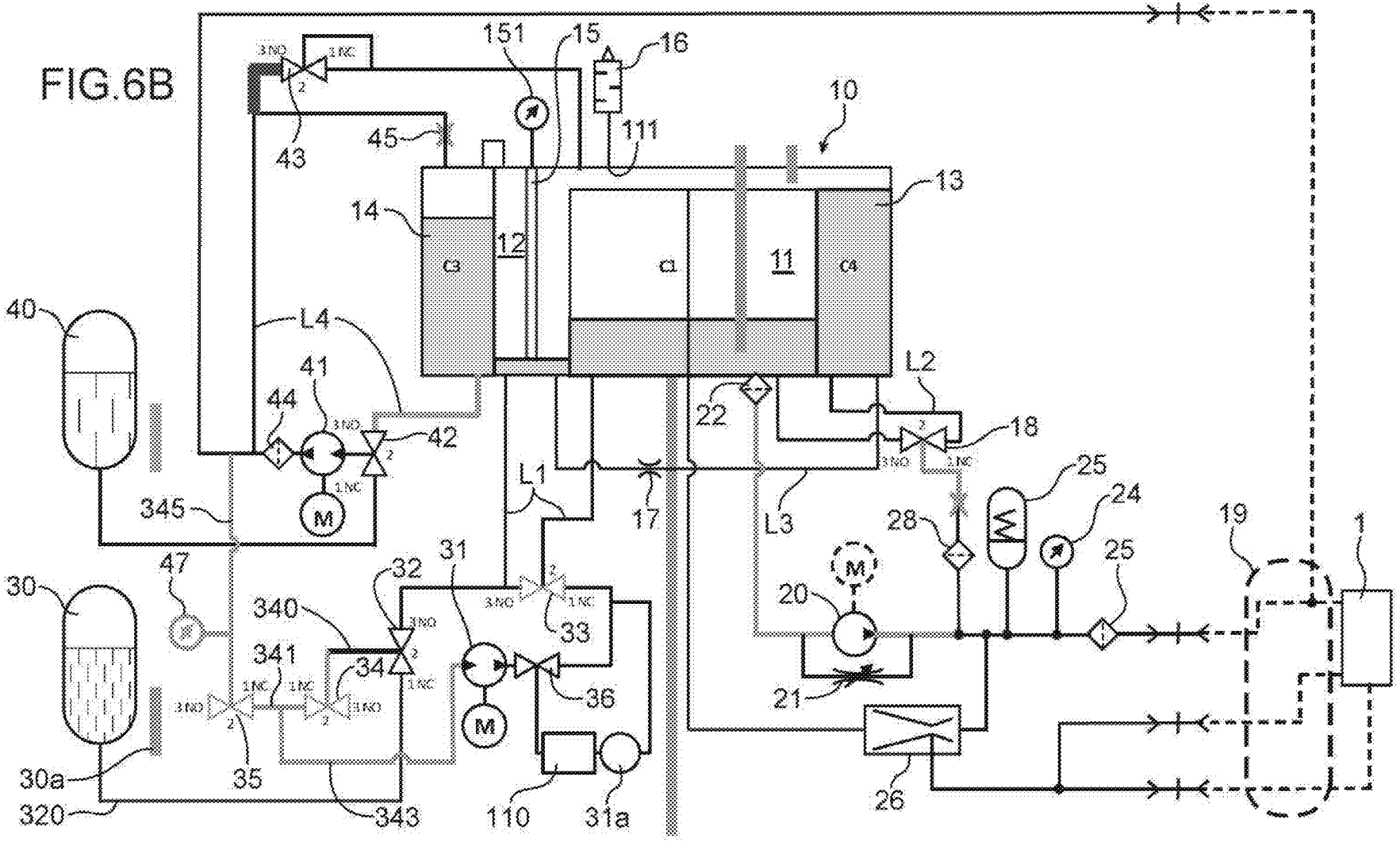
FIG. 6B shows an alternative of an exemplary fluid circuit structure using a circuit according to the present invention.

An alternative of the above-described circuit in relation with FIG. 6A is shown in FIG. 6B; this circuit is identical to that of FIG. 6A, but implements an intermediate tank 110, as in FIG. 3B, with the same advantages as those set forth above in relation to this FIG. 3B: the three-way valve 36 makes it possible to direct the solvent either directly towards the main tank 10 (along the path I), or towards the intermediate tank 110 (along the path Ia). The additional pump 31*a* subsequently enables the content to be pumped from this tank towards the main tank 10. The valve 36 and the pump 31*a* can be actuated by the machine controller, programmed to do so.

The invention has a particularly interesting application in the case of an ink containing dispersions of dense particles such as metals or pigments of metal oxides. For example, titanium, zinc, chromium, cobalt or iron, (such as $TiO_2$, ZnO, $Fe_2O_3$, $Fe_3O_4$, . . . ) as micronic or sub-micronic particles. Such a pigmented ink, for example a $TiO_2$-based ink, can be used for marking and identifying black or dark media.

But it is also interesting in the case of any non-pigmented ink, which, as already explained, can dry and form deposits of dry matter in the ducts and connections of the ink circuit.

What is claimed is:

1. A method for cleaning an ink circuit of an ink-jet printer, comprising at least one tank, referred to as the main tank, at least one removable ink cartridge, a pump for pumping the ink from the ink cartridge and fluid connections between the ink cartridge and the tank, and a controller of the printer, this method comprising at least:

a) a step of sending solvent, at a pressure P1, to the ink cartridge, by at least a part of the fluid connections between the ink cartridge and the tank, and b) a step of pumping at least a portion of the solvent, sent in step a), towards the main tank, wherein during step a), the solvent is sent to the cartridge by a part of the fluid connections between the ink cartridge and the tank, the solvent flowing in the reverse direction to the flowing direction of the ink when the latter is sent from the ink cartridge towards the tank.

2. The method according to claim 1, wherein step b) is carried out using said pump for pumping the ink, from said ink cartridge towards the main tank.

3. The method according to claim 1, further comprising at least a reiteration of steps a) and b).

4. The method according to claim 1, wherein the pressure P1 is between 1 bar and 10 bars.

5. The method according to claim 1, further comprising a step of sending solvent to the cartridge and in at least a part of the fluid connections between the ink cartridge and the main tank, without a step of pumping at least a portion of the solvent thus sent towards the main tank.

6. The method according to claim 1, comprising a step, prior to step a), of:

detecting the presence of the ink cartridge, for example by exchanging at least one datum, between a circuit associated with the cartridge and the controller of the printer; and detecting the empty state of the ink cartridge, for example from at least one measurement of an ink level in the main tank.

7. The method according to claim 1, the solvent sent during step a) being taken:

in a solvent compartment of the main tank, the method comprising a step, prior to step a), of detecting the solvent level in said solvent compartment of the main tank; or in a solvent cartridge.

8. The method according to claim 1, comprising a step, prior to step a), of detecting the clogged state of at least a part of the fluid connections between the ink cartridge and the tank, for example by measuring the variation in the ink level in the main tank, following or during an ink pumping from the ink cartridge towards the main tank.

9. The method according to claim 8, comprising, after step a), maintaining the solvent under pressure P1 and measuring a variation in the solvent pressure or in the level or volume of the solvent.

10. The method according to claim 9, comprising at least one step from a group consisting of:

performing one or more variations in the solvent pressure, if a decrease of variation in the solvent pressure, or in the level or volume of the solvent, greater than a threshold value, is not measured, and iterating measuring a variation in the solvent pressure or in the level or volume of the solvent and possibly performing one or more variations in the solvent pressure.

11. The method according to claim 1, further comprising at least one step from a group consisting of:

sending, during step a), solvent to the cartridge either without passing through the pump for pumping the ink from the cartridge, or by passing through said pump; and transferring, during step b), at least a portion of the solvent towards an intermediate tank, separated from the main tank.

12. The method according to claim 1, the solvent sent during step a) being injected into the fluid connections through a valve.

13. An ink circuit of a continuous ink-jet printer, comprising at least one tank, referred to as the main tank, a hollow needle for connecting at least one ink cartridge to said circuit, a pump for pumping ink from an ink cartridge, fluid connections between the hollow needle and the tank, and a controller of the printer, the latter being programmed to implement at least:

a) a sending solvent, at a pressure P1, to the ink cartridge, by at least a part of the fluid connections between the ink cartridge and the tank, and b) a pumping at least a portion of the solvent, sent in step a), towards the main tank, wherein during step a), the solvent is sent to the cartridge by a part of the fluid connections between the ink cartridge and the tank, the solvent flowing in the reverse direction to the flowing direction of the ink when the latter is sent from the ink cartridge towards the tank.

14. The ink circuit of a continuous ink-jet printer, comprising at least one tank, referred to as the main tank, a pump for pumping the ink towards the tank, a hollow needle for joining an ink cartridge to said circuit, fluid connections between said hollow needle and the tank, and a controller of the printer, said controller being provided for:

a) sending solvent, at a pressure P1, up into said hollow needle, through at least a part of said fluid connections, and b) pumping at least a portion of a solvent, present in said hollow needle and in at least a part of said fluid connections, wherein during step a), the solvent is sent to the cartridge by a part of the fluid connections between the hollow needle and the tank, the solvent flowing in the reverse direction to the flowing direction of the ink when the latter is sent from the hollow needle towards the tank.

15. The ink circuit according to claim 14, said fluid connections being connected to a circuit for injecting a solvent therein.

16. The ink circuit according to claim 14, comprising a sensor measuring an ink level in the main tank, said controller of the printer enabling a residual ink level in an ink cartridge connected to the fluid connections to be computed.

17. The ink circuit according to claim 14, further comprising an intermediate tank, separate from the main tank and a circuit for transferring at least a portion of a fluid, present in said hollow needle and in at least a part of said fluid connections, towards said intermediate tank.

18. The ink circuit according to claim 14, further comprising:

a circuit for sending solvent up into said hollow needle, through at least a part of said fluid connections, but without circulating the solvent through the pump for pumping the ink from the cartridge; or a circuit for sending the solvent up into said hollow needle, through at least a part of said fluid connections, by circulating the solvent through the pump for pumping the ink from the cartridge.

19. The ink circuit according to claim 14, further comprising a sensor for detecting the clogged state of at least a part of the fluid connections between the hollow needle and the tank, said sensor being for example for measuring the variation in the level of a fluid in the main tank.

20. The ink circuit according to claim 19, comprising at least one pump from a group consisting of:

a pump for maintaining a fluid under pressure in the circuit, as well as a sensor for measuring a variation in fluid pressure or in a level or volume of this fluid;

a pump for performing one or more pressure variations of the solvent in a case where a sensor for measuring a variation in fluid pressure or in a level or volume of this fluid does not detect a decrease in the fluid pressure, or in the level or volume of the fluid, greater than a threshold value; and a pump for performing or reiterating one or more variations in fluid pressure in the circuit, for example if a variation in fluid pressure or in a level or volume of this fluid is not detected.

21. A continuous ink-jet printer, comprising:

an ink circuit according to claim 14, a printing head, hydraulic connections, for bringing, from the ink tank, an ink to be printed to the printing head and sending, towards said ink circuit, an ink to be retrieved from the printing head, and electrical connections for supplying power to said printing head.

22. The ink circuit according to claim 14, the controller being provided for solvent to be sent:

from a solvent compartment of the main tank, the ink circuit for example comprising a sensor to detect the solvent level in said solvent compartment the main tank; or from a solvent cartridge.

23. The ink circuit according to claim 14, comprising a valve to send solvent up to said hollow needle.

* * * * *